US005096258A

United States Patent [19]

Mestre Boix

[11] Patent Number: 5,096,258

[45] Date of Patent: Mar. 17, 1992

[54] INTERFITTING FURNITURE

[76] Inventor: Luis Mestre Boix, Calle Lluna, 41, 08202 Sabadell (Barcelona), Spain

[21] Appl. No.: 555,435

[22] PCT Filed: Dec. 12, 1989

[86] PCT No.: PCT/ES89/00001

§ 371 Date: Aug. 9, 1990

§ 102(e) Date: Aug. 9, 1990

[87] PCT Pub. No.: WO90/06703

PCT Pub. Date: Jun. 28, 1990

[30] Foreign Application Priority Data

Dec. 13, 1988 [ES] Spain ..... 8803785

[51] Int. Cl.[5] ..... A47C 15/00

[52] U.S. Cl. ..... 297/233; 297/257; 108/65

[58] Field of Search ..... 297/233, 234, 235, 236, 297/239, 257; 108/65, 64, 11, 67

[56] References Cited

U.S. PATENT DOCUMENTS

| | | | |
|---|---|---|---|
| 53,188 | 3/1866 | Rose | 297/233 X |
| 117,775 | 8/1871 | Hart et al. | 297/233 X |
| 1,312,994 | 8/1919 | Leonard | 108/65 X |
| 1,631,811 | 6/1927 | Guenther | 155/46 |
| 2,628,371 | 2/1953 | Null | 5/158 |
| 4,760,801 | 8/1988 | Campbell | 108/119 |

FOREIGN PATENT DOCUMENTS

| | | | |
|---|---|---|---|
| 800426 | 10/1950 | Fed. Rep. of Germany . | |
| 2051841 | 4/1972 | Fed. Rep. of Germany | 108/65 |
| 1147375 | 11/1957 | France . | |
| 269750 | 11/1950 | Switzerland . | |
| 438524 | 11/1935 | United Kingdom | 297/233 |

*Primary Examiner*—Laurie K. Cranmer

*Attorney, Agent, or Firm*—Cushman, Darby & Cushman

[57] ABSTRACT

Interfitting furniture formed by the coupling together of a least two elementary pieces of furniture, each of which comprises a supporting portion and all the supporting portions are at the same height above floor level and each of them is formed by a plurality of elongated members, each of which defines with the adjacent ones a space which is substantially occupied by the corresponding elongated members of the supporting portion of other elementary pieces of furniture. Each of the elementary pieces, when slid apart for separate use, provides a furniture article having the same type of functionality as the more massive composite furniture article of which it, when reversibly assembled with one or more like or similar elementary pieces, forms a part.

16 Claims, 4 Drawing Sheets

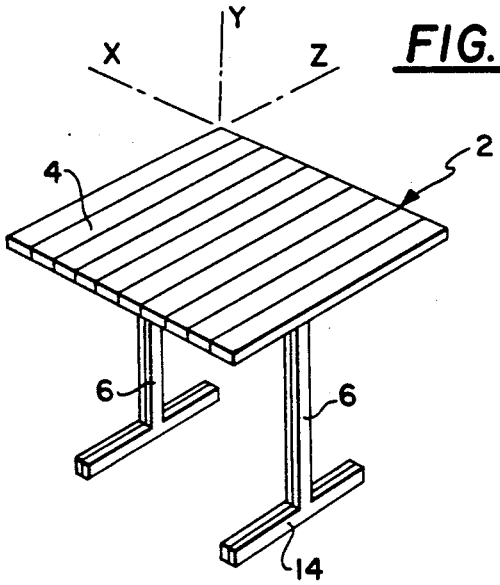
FIG. 1
FIG. 2
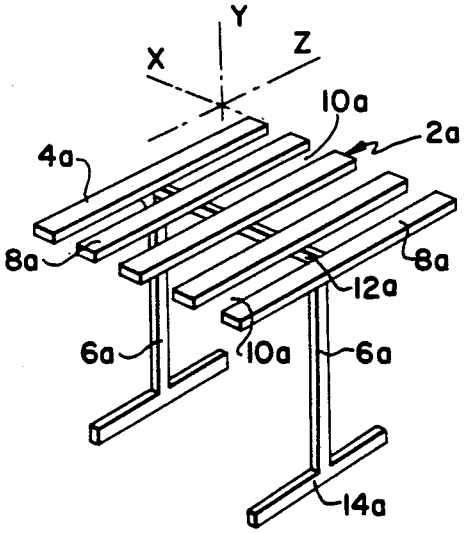
FIG. 3
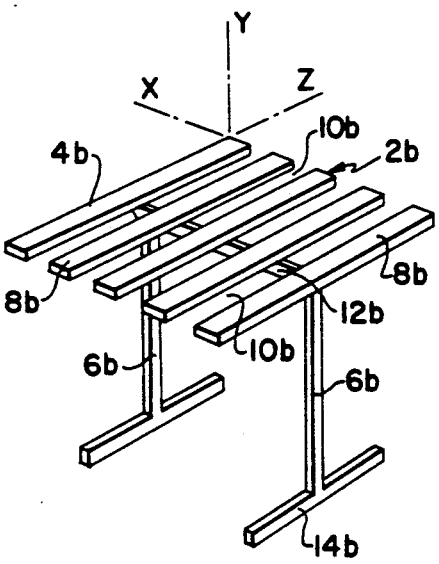

INTERFITTING FURNITURE

BACKGROUND OF THE INVENTION

The invention relates to interfitting furniture, formed by the coupling together of at least two elementary pieces of furniture, each of which comprises a supporting portion and support means for the supporting portion on the floor.

There is an increasing trend to reduce the size of dwellings owing to the increasing cost of building. This reduction is immediately reflected in the size of the rooms, whereby there is the need to make the most advantage of the available space.

Part of this space is occupied by furniture, whereby the interest that the design of new furniture should respond to the above need to make the most of the space is appreciated. Several embodiments are already known in this direction: some relate to the convertibility between different types of furniture, such as the so-called bed settee; the prototype of others is to be found in the so-called pull-out bed, in which an upper bed is superimposed on a lower bed of a much lower height., and others are based on nested piled furniture, although it should be noted that the latter may not be used when they are piled.

SUMMARY OF THE INVENTION

It is an object of the invention to provide a piece of furniture which may be subdivided into two or more pieces, all in such a way that the piece of furniture may be used for its specific function both when subdivided and before being subdivided.

This is achieved with a piece of furniture of the type first mentioned above which is characterized in that the supporting portions of all the elementary pieces are at the same height above floor level and each of said supporting portions is formed by a plurality of elongated members, each of which defines with the adjacent ones a space which is substantially occupied by the corresponding elongated members of the supporting portion of other elementary pieces of furniture.

Preferably, the floor support means for each elementary piece of furniture may be generally juxtaposed to the floor support means of the immediately adjacent elementary piece of furniture.

BRIEF DESCRIPTION OF THE DRAWINGS

Further advantages and features of the invention will be appreciated from the following description in which there are given preferred embodiments of the invention without any limiting nature, with reference to the acompanying drawings in which:

FIG. 1 is a perspective view of an interfitted piece of furniture of the invention.

FIGS. 2 and 3 are respective perspective views of two elementary pieces of furniture forming the interfitted piece of furniture of FIG. 1.

DETAILED DESCRIPTION

Figure 4:
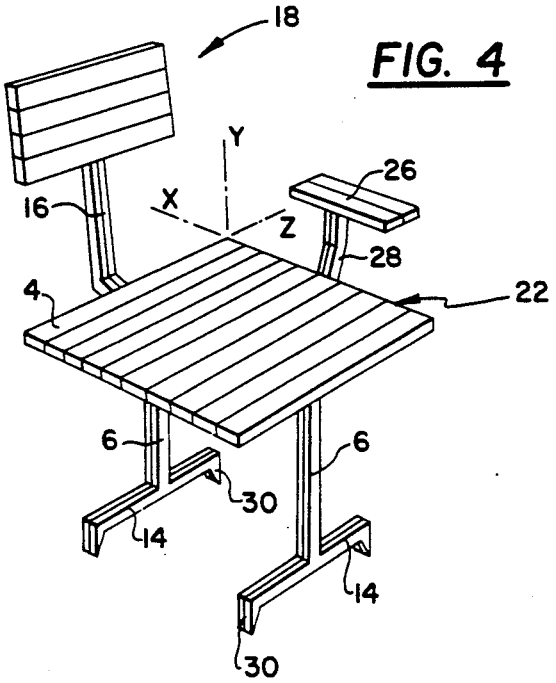
FIG. 4 is a perspective view of another embodiment of the interfitted piece of furniture of FIG. 1.

FIG. 1 is a perspective view of a particularly simple embodiment of an interfitted piece of furniture having the appearance of a stool 2. There is to be seen a supporting portion 4, which term is used herein to mean the part of the piece of furniture serving as to support the user of the piece of furniture, such as the seat portion of a piece of furniture for sitting (stool, chair, armchair, etc.) or the space on which the user of a bed, divan, table, etc., lies, lays or uses.

The supporting portion 4 is associated with the floor by floor support means 6. The interfitted piece of furniture is shown in connection with orthogonal axes x, y, z, which are indicated at one corner of the supporting portion 4.

FIG. 2 is a similar view of an elementary piece of furniture 2*a*, which is provided with a supporting portion 4*a* formed by a plurality of elongated members 8*a*, which in this case are straight, although it is contemplated that they may be orientated in straight line but have a vertically curved or wavy portion. Between each two elongate members 8*a* there is space 1O*a*, the width of which is substantially that of the elongate members, or slightly wider. The elementary piece of furniture 2*a* is provided with corresponding support means 6*a*.

FIG. 3, in turn, shows a perspective view of a second elementary piece of furniture 2*b*, with the corresponding supporting portion 4*b* also formed by straight elongate members 8*b*, between which there are defined spaces 1O*b*. The piece of furniture 2*b* also comprises support means 6*b* of the same length as the means 6*a*, such that both supporting portions 4*a* and 4*b* are at the same height above floor level.

Both elementary pieces of furniture 2*a*, 2*b* are also shown in connection with orthogonal axes x, y, z, which allow the offset between the elongate members 8*a* and 8*b* to be defined, so that these elongate members correspond respectively with the spaces 10*b* and 10*a*.

When the elementary piece of furniture 2*a* is caused to slide horizontally relative to the piece 2*b* in the appropriate direction, the spaces 10*a*, 10*b* are occupied by the elongated members 8*b* and 8*a*, whereby the interfitted piece of furniture 2 is formed.

In the example described, each elementary piece of furniture is provided with a single central crossmember 12*a*, 12*b* disposed transversely to the respective elongated members 8*a*, 8*b*. Both central crossmembers are juxtaposed when the interfitted piece of furniture 2 is formed, forming the complex crossmember (thereof which is not shown in the drawings).

Nevertheless, it is contemplated that each elementary piece of furniture may have a single off-centre crossmember or two or more crossmembers. In the latter case, it is preferred that one crossmember of one elementary piece of furniture be juxtaposed with one crossmember of the other when the elementary pieces of furniture are combined to form the interfitted piece of furniture.

In the example shown, the support means 6a, 6b are legs which emerge from end portions of the central crossmembers 12a, 12b and the support means are also juxtaposed when the pieces are combined to form the interfitted piece of furniture.

The two centre crossmembers are slightly staggered to make the juxtapositioning of the crossmembers compatible with the juxtapositioning of the floor support means. In the embodiment described, the legs are vertical and rest on respective elongate feet 14a, 14b generally parallel to the respective elongated members 8a, 8b.

From the above, it is easy to imagine a further solution in which each leg 6a, 6b is divided into two sloping legs, whereby the pieces of furniture would be provided with four bearing points.

It is to be noted that in the embodiment described, each of the elementary pieces of furniture has the same essential functionality, which is substantially the same as that of the interfitted piece of furniture. Therefore, when an interfitted piece of furniture (fully adequate for its intended use) is owned, there is the possibility of immediately obtaining a multiplication thereof (duplication in this case), whereby the corresponding elementary pieces of furniture which are also suitable for the same use as the interfitted piece of furniture itself are obtained. The interfitted piece of furniture clearly represents a great saving in space, without prejudice either to its use or to the decorative aspect thereof.

Figure 5:
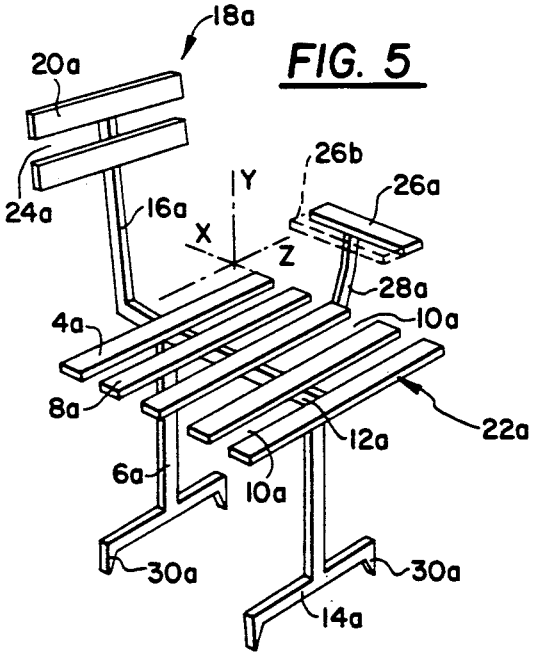
FIGS. 5 and 6 are respective perspective views of two elementary pieces of furniture forming the interfitted piece of furniture of FIG. 4.
Figure 6:
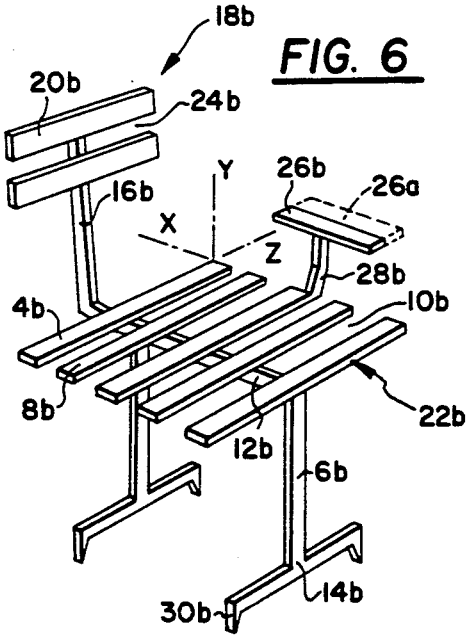

FIGS. 4 to 6 show another embodiment of an interfitted piece of furniture 22, formed by the coupling together of two elementary pieces of furniture 22a and 22b. In all these drawings, the same reference numbers have been used for like members to those shown in FIGS. 1 to 3.

The pieces of furniture of FIGS. 4 to 6 are more complex. In them, each crossmember is provided with a bent extension defining a bar 10a, 10b, which bars are juxtaposed when coupled together to form the complex piece of furniture 22, forming the complex bar 16. If there is more than one crossmember, it is contemplated that each of them be associated with a bar such as described.

To each bar, there is attached a backrest portion 18a, 18b formed by one or more horizontal boards (20a, 20b), which may define spaces 24a, 24b which may be occupied by the horizontal boards of the other elementary piece of furniture. In this way, there is provided an interfitted piece of seat furniture, provided with a backrest and therefore more comfortable.

Furthermore, possibly independently of the backrest portions, there is contemplated the provision of an elementary side arm 26a in the elementary piece of furniture 22a, which is horizontally staggered relative to the elementary side arm 26b of the elementary piece of furniture 22b, the staggered position being shown offset in phanton line in each case. The elementary arms 26a, 26b are respectively attached to rods 28a, 28b which may be attached to corresponding elongate members 8a, 8b.

It may be noted how the interfitted piece of furniture 22 may be divided into elementary pieces of furniture; to this end, the side on which the arm 26 is mounted is pulled in the direction of the elongated members. On the contrary, for coupling the interfitted piece of furniture 22 together from the elementary pieces of furniture, the piece 22a is situated to the left of the piece 22b and the elongated members 8a are inserted in the spaces 10b at the same time as the horizontal boards 20a penetrate in the spaces 24b.

In this embodiment, the elongated feet 14 are provided with support tips 20a, 30b to facilitate their stability. In this case, it is also contemplated that each vertical leg 6 may be replaced by two sloping legs providing a total of four bearing points.

In the above-described cases, it is contemplated that the elongated members 8a, 8b be provided on the upper surface thereof with padding for greater comfort. Preferably, the padding is of considerably height and is elastically deformable; under these conditions, when one sits on an elementary piece of furniture, the padding deforms horizontally and thereby attenuates the sensation of discontinuity caused by the spaces 10a, 10b. This horizontal deformation is almost non-existent in the interfitted piece of furniture, since each body of padding bears against the padding of another elementary piece of furniture.

Figure 7:
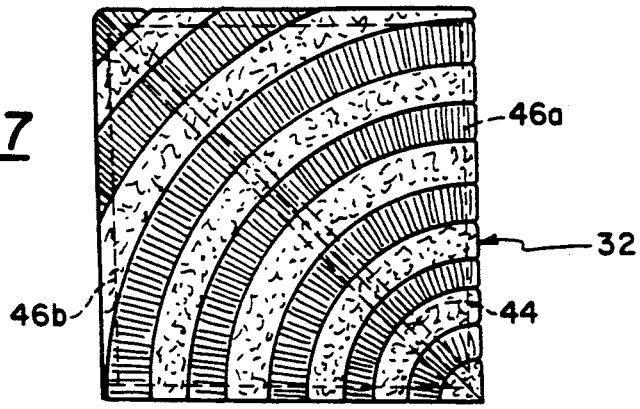
FIG. 7 is a schematic plan view from above of a further embodiment of a piece of interfitted furniture.
Figure 8:
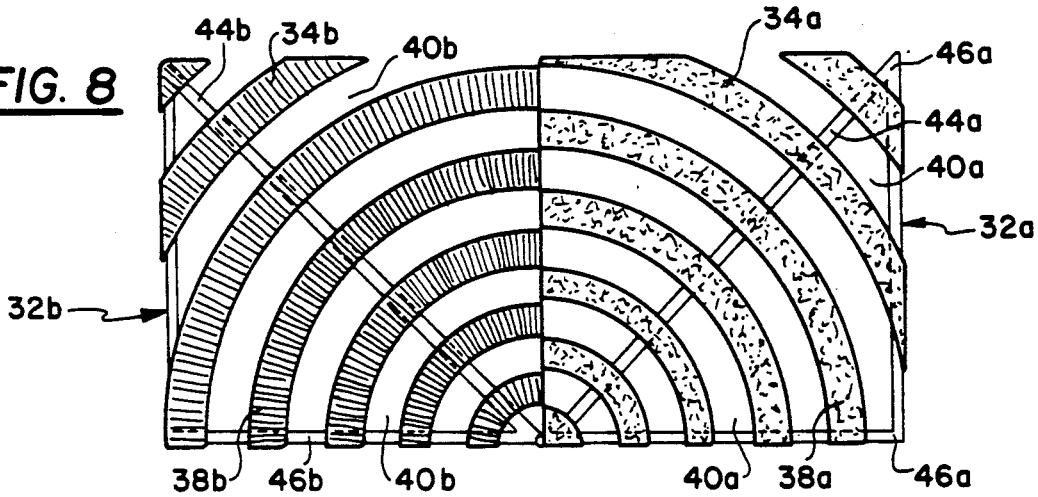
FIG. 8 is a schematic plan view from above of the elementary pieces of furniture forming the interfitted piece of furniture of FIG. 7; in both figures the elongated arcuate members of each elementary piece of furniture have been shaded differently.
Figure 9:
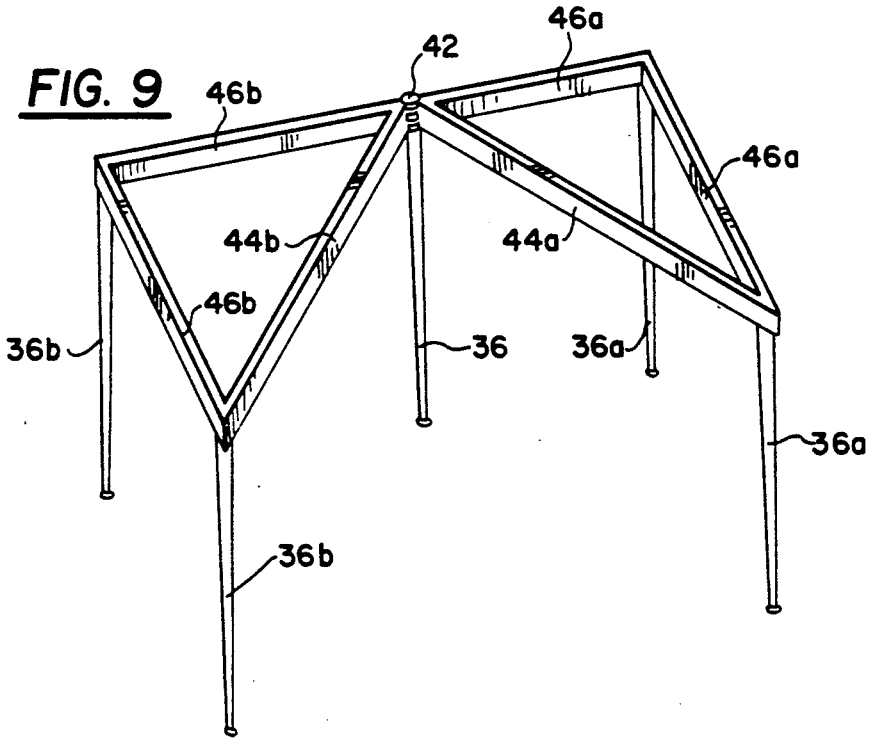
FIG. 9 is a perspective schematic view of the frame of the elementary pieces of furniture of FIG. 8.

A further embodiment is shown in FIGS. 7 to 9. The interfitted piece 32 of furniture is formed by the coupling together of the elementary pieces 32a and 32b of furniture. Each of the latter is provided with a supporting portion 34a, 34b formed by arcuate elongated members 38a, 38b, separated by spaces 40a, 40b, also obviously arcuate. The members 38a and the spaces 40a are offset relative to the corresponding members 38b and spaces 40b, although all are at the same height above floor level.

A rotary movement of one elementary piece of furniture relative to the other couples them together and forms the interfitted piece 32 of furniture. Preferably the two elementary pieces 32a, 32b of furniture are pivoted to the same hinge 42 and each is provided with the single diagonal crossmember 44a, 44b, as well as other strips 46a, 46b, forming a frame on which the elongated members rest. Support means are formed by legs 36a, 36b, together with a common leg 36.

In the foregoing embodiments, the invention has been disclosed in terms of a piece of furniture for sitting on. Nevertheless, other embodiments having, for example, the form of a divan or bed, are contemplated by the invention.

Figure 10:
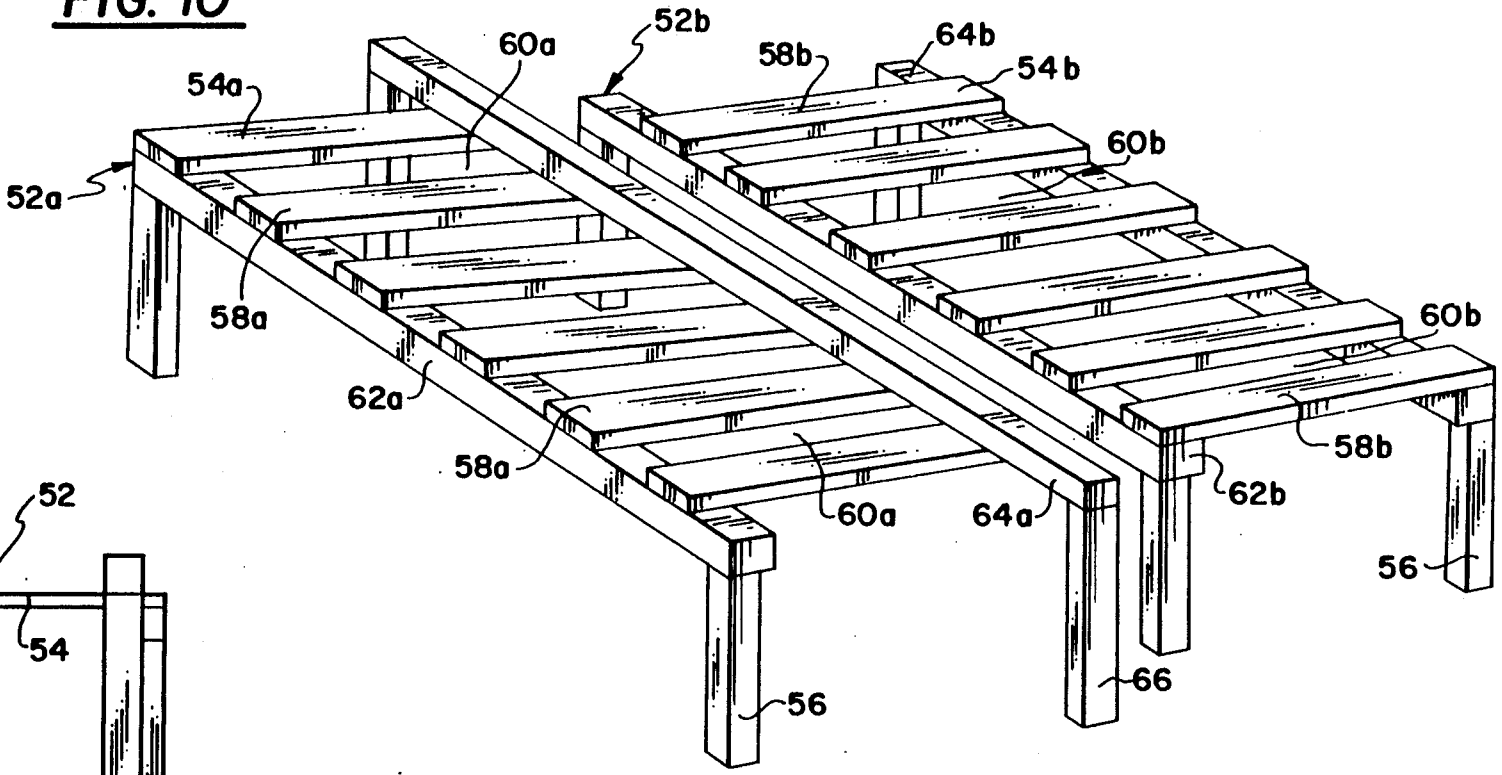
FIG. 10 is a schematic perspective view of yet another embodiment of two elementary pieces of furniture.

The perspective view of FIG. 10 shows a front elementary piece 52a of furniture and a rear elementary piece (52b) of furniture defining supporting portions (54a, 54b) of sufficient dimensions to form of bed.

As in the previous cases, the said supporting portions are formed respectively, by elongated members 58a defining therebetween spaces 60a, and by further elongated members 58b defining in turn other spaces 60b. All the elongated members are at the same height above floor level and the spaces of one of the elementary pieces of furniture may be substantially filled by the elongated members of the other elementary piece of furniture.

The elongated members 58a are attached to a front stringer 62a and to a rear stringer 60a; similarly, the elongated members 58b are attached to a front stringer 62b and to a rear stringer 64b. Nevertheless, it is to be noted that the rear stringer 64a of the front elementary piece 52a of furniture is fully above the upper surface 66 of the elongated members. In turn, the front stringer 62b of a rear elementary piece 52b of furniture is in no place higher than the lower surface 68 of the elongated members. It is thereby possible for the rear elementary piece 52b of furniture to be inserted in and interfit with the piece 52*a*, without either the rear stringer 64*a* of the front piece 52*a* or the front stringer 62*b* of the rear piece 52*b* interfering with the elongated members 58*a*, 58*b*. Under these conditions, it is possible to form the interfitted piece 52 of furniture in which the elongated members 58*a*, 58*b* are alternately located and where both front stringers 62*a*, 62*b* are juxtaposed.

Preferably, all the stringers are mounted on support means or legs 56, although the legs 66 of the rear stringer 64*a* of the front piece 52*a* define a longer span than the legs of the front stringer 62*a*, to allow for the passage of the latter.

The invention also contemplates that the rear elementary piece 52*b* may be a front piece relative to a second rear elementary piece of furniture, not shown in the drawing. In this case, the features relating to the rear and front stringers should be repeated.

In many of the above cases, the elongate members of one of the elementary pieces of furniture are attached to a lower plate. They are attached by means of vertical members extending from below each elongate member All the embodiments described provide the important advantage of affording a piece of furniture which occupies the space of one single piece of furniture is in condition to be used and may be converted into two or more pieces of furniture of identical functionality.

It is clear that the interfitting furniture of the invention responds to a reality other than the simple piling of furniture, since the component parts of such piles may only be used when they have been removed individually from the pile. Furthermore, the interfitting furniture of the invention are quite compatible with the decoration of an environment without giving the idea of provisionality of a pile and without the unpleasent appearence of such piles.

In other words, the present invention provides a composite furniture article which is reversibly constituted by sliding together so that they intercalate (interlock or interdigitate), two or more less massive furniture articles, each of which, when slid apart for separate use, provides a furniture article having a same type of functionality as the composite article of which it can form a part. In this sense, a composite table is separable into two or more less massive tables, and a composite chair is separable into two or more less massive chairs. In each instance, the upwardly facing support surface of each separate less-massive furniture article is located in the same plane as the upwardly facing support surface of the respective composite furniture article.

Figure 11:
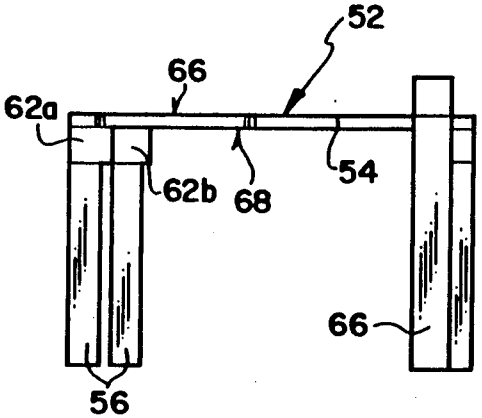
FIG. 11 is a side elevation view showing how the elementary pieces of furniture of FIG. 10 are interfitted.

In the case of the so-called pull-out beds, that is beds where one is stored below the other, it should be noted that each bed has a different height whereas the interfitting piece of furniture of FIGS. 10 and 11 provides two or more beds or divans of the same height.

What I claim is:

1. A composite furniture article, comprising:

at least two separate elementary furniture articles, each of which includes:

a supporting portion comprising a plurality of generally horizontal, elongated, laterally spaced supporting portion elements which, together, provide an upwardly facing support surface; and a support means which includes at least one generally vertically oriented element, having upper end cross-member means laterally interconnecting all of said supporting elements, and having lower end floor engagement means for supporting the respective elementary furniture article on a floor so that its upwardly facing support surface is disposed in a plane having a given level above where said floor engagement means are disposed for engaging a floor;

said elementary furniture articles being separably slid together to provide a composite supporting portion in which said supporting portion elements of a plurality of said elementary furniture articles are mutually intercalated into spaced between respective adjacent ones of said supporting portion elements on respective ones of said elementary furniture articles so as to provide, together, an upwardly facing composite support surface disposed at said given level.

2. The composite furniture article of claim 1, wherein:

respective ones of said vertically oriented elements of said plurality of elementary furniture articles are clustered in respective groups of horizontally adjacent, vertically oriented elements.

3. The composite furniture article of claim 1, wherein:

on each said elementary furniture article, said generally horizontal, elongated, laterally spaced supporting portion elements are substantially straight, and parallel to one another.

4. The composite furniture article of claim 3, wherein:

on each said elementary furniture article, said cross-member means is constituted by a sole cross-member element to which are mounted all of the respective said generally horizontal, elongated, laterally spaced supporting portion elements.

5. The composite furniture article of claim 4, wherein:

on each said elementary furniture article, said sole cross-member element is disposed substantially orthogonally transverse to the respective said horizontal, elongated, laterally spaced supporting portion elements; and respective ones of said cross-member elements of said plurality of elementary furniture articles are clustered into a sole group of horizontally adjacent, generally horizontally oriented elements.

6. The composite furniture article of claim 4, wherein:

on each said elementary furniture article, said sole cross-member has two opposite ends and said at least one generally vertically oriented element comprises two legs respectively joined to said sole cross-member at said opposite ends of said sole cross-member.

7. The composite furniture article of claim 6, wherein:

on each said elementary furniture article, said lower end floor engagement means comprises a plurality of horizontally elongated feet, each disposed at a lower end of a respective said generally vertically oriented element so as to form a generally coplanar structure with the respective said generally vertically oriented element.

8. The composite furniture article of claim 7, wherein:

on each said elementary furniture article each said coplanar structure is generally inverted T-shaped, so that each said foot has two opposite free ends; each foot free end being provided with a downwardly directed support tip for supporting the respective foot on a floor.

9. The composite furniture article of claim 3, wherein:

on each said elementary furniture article, said cross-member means is constituted by at least two transversally spaced cross-member elements, to each of which are mounted all of the respective said generally horizontal, elongated, laterally spaced supporting portion elements;

on each said elementary furniture article, all of the respective said cross-member elements being disposed substantially orthongonally transverse to the respective said horizontal, laterally spaced supporting portion elements;

respective ones of said cross-member elements of said plurality of elementary furniture articles being clustered into a plurality of respective groups of horizontally adjacent, generally horizontally oriented elements.

10. The composite furniture article of claim 9, wherein:

on at least one said elementary furniture article, at least one of said transversally spaced cross-member elements is superimposed on the respective said generally horizontal, elongated, laterally spaced supporting elements from above, so that said one elementary furniture article can be horizontally slid into and out of togetherness with at least another of said elementary furniture articles, for constituting and disassembling said composite furniture article.

11. The composite furniture article of claim 1, wherein:

each elementary furniture article further includes a backrest constituted by at least one generally horizontally facing elongated element, and rod means mounting each said horizontally facing elongated element to a respective said cross-member means;

respective ones of said horizontally facing elongated elements being disposed in mutual adjacency to provide a composite backrest for said composite furniture article.

12. The composite furniture article of claim 1, wherein:

each elementary furniture article further includes at least one armrest each constituted by at least one generally upwardly facing, generally horizontal elongated armrest element, and rod means mounting each said armrest element to a respective said supporting portion;

respective ones of said armrest elements being disposed in mutual adjacency to provide at least one composite armrest for said composite furniture article.

13. A composite furniture article, comprising:

at least two elementary furniture articles, each of which includes:

a supporting portion comprising a plurality of generally horizontal, elongated, laterally spaced supporting portion elements which, together provide an upwardly facing support surface; and a support means which includes at least one generally vertically oriented element, having upper end cross-member means laterally interconnecting all of said supporting elements, and having lower end floor engagement means for supporting the respective elementary furniture article on a floor so that its upwardly facing support surface is disposed in a plane having a given level above where said floor engagement means are disposed for engaging a floor;

said elementary furniture articles being separably slid together to provide a composite supporting portion in which said supporting portion elements of a plurality of said elementary furniture articles are mutually intercalated into spaced between respective adjacent ones of said supporting portion elements on respective ones of said elementary furniture articles so as to provide, together, an upwardly facing composite support surface disposed at said given level; and wherein on each said elementary furniture article, said generally horizontal, elongated, laterally spaced supporting portion elements are arcuate and disposed concentrically.

14. The composite furniture article of claim 13, wherein:

on each said elementary furniture article, said cross-member means is constituted by a sole cross-member which is oriented radially of the respective generally horizontal, elongated, laterally spaced supporting portion elements, and to which all of the respective said generally horizontal, elongated, laterally spaced supporting portion elements are mounted;

respective ones of said cross-member elements of said elementary furniture articles being clustered into a sole group of horizontally adjacent, generally horizontal horizontally oriented elements.

15. The composite furniture article of claim 14, wherein:

said composite supporting portion is generally square in top plan profile, and said sole group extends diagonally thereof.

16. The composite furniture article of claim 15, wherein:

on each said elementary furniture article, said sole cross-member has two opposite ends and said at least one generally vertically oriented element comprises two legs respectively joined to said sole cross-member at said opposite ends of said sole cross-member.

* * * * *